US006093012A

United States Patent [19]

Hess et al.

[11] Patent Number: 6,093,012

[45] Date of Patent: Jul. 25, 2000

[54] FORM FOR MANUFACTURING CONCRETE FORM COMPONENTS BY MACHINE

[75] Inventors: Herbert Hess, Maselheim; Gottfried Keller, Allmendingen, both of Germany

[73] Assignee: RAMPF Formen GmbH, Allmendingen, Germany

[21] Appl. No.: 08/725,023

[22] Filed: Oct. 2, 1996

[30] Foreign Application Priority Data

Oct. 5, 1995 [DE] Germany ..... 195 37 077
Mar. 1, 1996 [DE] Germany ..... 296 03 783 U

[51] Int. Cl.[7] ..... B28B 3/02

[52] U.S. Cl. ..... 425/346; 425/405.1; 425/419

[58] Field of Search ..... 425/405.1, 344, 425/352, 346, 412, 419

[56] References Cited

U.S. PATENT DOCUMENTS

| | | | |
|---|---|---|---|
| 3,222,748 | 12/1965 | Lamb . | |
| 3,830,615 | 8/1974 | Walchhuetter | 425/344 |
| 3,833,333 | 9/1974 | Britten | 425/405.1 |
| 4,395,213 | 7/1983 | Springs et al. | 425/211 |
| 4,545,754 | 10/1985 | Scheidt et al. | 425/419 |
| 4,576,092 | 3/1986 | Yamato | 100/295 |
| 4,614,488 | 9/1986 | Sigerist | 425/405.1 |
| 4,753,160 | 6/1988 | Baird et al. | 425/406 |
| 4,788,023 | 11/1988 | Buhler et al. | 425/405.1 |
| 5,599,566 | 2/1997 | Casolari | 425/405.1 |
| 5,612,065 | 3/1997 | Keller | 425/356 |

FOREIGN PATENT DOCUMENTS

| | | |
|---|---|---|
| 0118872 | 9/1984 | European Pat. Off. . |
| 0211449 | 2/1987 | European Pat. Off. . |
| 2406688 | 8/1975 | Germany . |
| 88/06084 | 8/1988 | WIPO . |
| 91/05111 | 4/1991 | WIPO . |

*Primary Examiner*—James P. Mackey
*Attorney, Agent, or Firm*—Venable; George H. Spencer; Allen Wood

[57] ABSTRACT

A description is given of a mold for manufacturing concrete moldings, e.g. paving setts, large-volume blocks and large-format, thin panels, having a bottom mold part which comprises the mold chamber(s) and having a top mold part with a load plate and the die or the dies. The bottom die parts (47) which come into contact with the concrete in each case are guided so as to be movable in the vertical direction, with respect to the top mold part, in a displacement range defined by stops (46, 51, 53) and are exposed to the action of a pressure medium, e.g. a bellows (40) activated by compressed air. The manufacturing process claimed works with two successive fillings. After the first filling pre-compaction is carried out at a relatively high pressure, and after the second filling secondary compaction is carried out at reduced pressure, the reduced pressure resulting in desired striking of the movable die part against the other die in the same rhythm as the vibrations.

10 Claims, 5 Drawing Sheets

FORM FOR MANUFACTURING CONCRETE FORM COMPONENTS BY MACHINE

BACKGROUND OF THE INVENTION

The invention relates to a mold for manufacturing concrete moldings by machine, having a bottom mold part with at least one mold chamber and having a top mold part with a load plate, and there being as many dies as mold chambers.

Filling of the bottom mold parts of such molds in the production machine takes place by means of a so-called filling carriage. This is a flat hopper which contains the molding material and is moved back and forth directly above the top edges of the mold chambers. The material thus drops into the chambers and is scraped up flush by the border of the filling carriage as the latter makes its return movement. However, the concrete, which is only pourable to a limited extent, is usually distributed unevenly in the filling carriage and, depending on the position of the individual chambers within the mold and/or depending on the size of the mold-chamber surface area, different traversing times which are available for the molding material to be lowered into the chambers are necessarily produced. Uniform filling of the mold chambers is thus problematic.

However, if the individual mold chambers are filled with different quantities or if, in the case of a large-surface-area mold chamber, the concrete filling is distributed unevenly therein, this produces moldings of at least locally differing densities and/or heights, depending on the extent to which the top mold part remains parallel to the mold table during compaction. In the case of elongate molds, despite all efforts being made in design terms, this cannot always be ensured to the desired extent.

It is indeed already known, from DE 24 06 688 A1, to actuate the dies of multichamber molds by means of individual hydraulic cylinders which are activated by the same pressure source in order, in view of non-uniform filling of the mold, at least to carry out compaction uniformly and consequently to avoid differences in strength of the individual moldings. Nevertheless, differing heights have to be accepted here, although, for some products, this is not really disadvantageous.

SUMMARY OF THE INVENTION

The object of the invention is to specify a mold by means of which it is possible, using the same filling method, to manufacture concrete moldings of highly uniform density, uniform height and uniform surface texture. Principal examples of concrete moldings are, on the one hand, concrete paving setts, for which multichamber molds are used, and, on the other hand, largevolume concrete blocks and, in particular, large and comparatively thin panels, which are manufactured in single molds or double molds.

Based on a mold of the type described in the introduction, this object is achieved according to the invention by a mold having a top mold part whose bottom die parts or pressure-exerting plates which come into contact with the concrete are guided so as to be movable in the vertical direction, with respect to the top mold part, in a displacement range defined by stops, it being possible for this capacity for movement or vibration to be changed optionally. For this purpose, the bottom die parts are forced downwards under the action of a pressure medium. Depending on the pressure setting, the dies or the die is or are flexible. If the pressure is reduced or eliminated completely, with the result that the movable die parts come to rest against their top stops, then these are inevitably set to be level with one another and parallel to the mold table.

The basic idea is to carry out a two-stage compacting process in such a manner that, first of all, yielding dies (subjected to air pressure) carry out pre-compaction and, after secondary filling of the resulting chamber cavities of different depths, dies which are level with one another and are parallel to the mold table, or a parallel die, carry out, or carries out, the secondary compaction. The state of being parallel to the mold table is achieved as soon as the air pressure is lowered to such an extent that the pressure-exerting plate of the die comes to rest against the stops, over-coming the force of a pressure-medium chamber with movable wall in doing so. In this secondary compaction, the setting of the lowered air pressure is extremely important. In particular, it is proposed that, in order to utilize fully the striking action described below, the air pressure is lowered further during the secondary compaction phase. The pressure can be lowered continuously. In this arrangement, the air pressure may reach the value of 0 before completion of the secondary compaction operation or upon completion thereof.

The compaction is aided in particular by an important striking effect which takes place here. This is because it is possible, by sensitive setting of the air pressure, to achieve a situation where the pressure-exerting plates, rather than simply resting against their stops, dance thereon, i.e. hit off said stops again and again. This makes it possible to manufacture large concrete panels of, for example, 70×90 cm arid above with a crack-free, perfectly uniformly smooth surface, which has not been possible hitherto, in particular in the case of comparatively thin panels. A further great advantage of the capacity for vibration of the pressure-exerting plates of the dies or of the resulting striking action is that the concrete panels do not remain "stuck" to the pressure-exerting plates, but rather are easily detached therefrom.

Essentially the same force acts on each die during the pre-compaction. With the different fillings in the chambers assumed here, this uniform compaction results in half-finished moldings of heights which differ considerably. Thus, during the second filling, a large amount of material is also introduced as a secondary filling wherever there is a great lack of material, this secondary filling operation causing the existing cavities to be filled completely as a result of the comparatively small secondary filling quantities. Taken as a whole, the sums of the first and second filling quantities for each chamber are virtually equal, the result being moldings whose height corresponds extremely well to the accuracy requirements in practice of, for example, 1 mm and which also have the same density and thus the same strength.

The use of such a mold is not limited to two filling and compacting operations. In special cases, it should also be possible for three or more operations to take place, the pressure medium being subjected to pressure for the pre-compactions and the pressure being reduced or eliminated completely only during the final compaction.

For the design of pneumatic lifting devices for the movable die parts, it is proposed that, in the case of a multi-chamber mold, there is provided on each die a pressure-medium chamber which is activated by a common compressed-air source, acts on the relevant bottom die part and has a movable wall. This wall, e.g. a diaphragm or bellows, may, in the case of a die which has a shank and a movable pressure-exerting plate at the bottom end thereof, be arranged in the vicinity of the pressure-exerting plate. On the other hand, it is also possible to arrange the individual pressure-medium chambers so as to be approximately level with the common load plate and to transmit their compressive forces to the pressure-exerting plates via a movable die shank in each case or via special rams, the rams, in this case, passing through the tubular die shanks.

A preferred development of the invention is, as has been mentioned, based on the fact that the pressure-medium chamber is arranged at the bottom of the die, in the vicinity of the movable pressure-exerting plate. It is proposed that there is arranged on each die, between a foot plate, firmly connected to the die shank, and the pressure-exerting plate, an insert which has a top part with a top plate and a bottom part which is guided so as to be vertically movable with respect to the top part and has a bottom plate, the top plate being screwed to the foot plate and the bottom plate being screwed to the pressure-exerting plate. The insert further contains at least one bellows, which can be activated by compressed air, and the stops for delimiting the displacement range of the two parts of the insert. Such an insert has the advantage that loads with pressure-exerting plates which have hitherto been screwed firmly on the die foot plates can be changed over quickly and simply, so that the pressure-exerting plates can be moved in accordance with the idea of the invention and can be controlled in terms of their vibration. With corresponding dimensioning, the screw holes in the die foot plates and the pressure-exerting plates can be used for the retrofitting.

For mutual vertical guidance of the two parts of an insert, preferably interengaging guide pins and sleeves are arranged on said parts. As stops for delimiting the displacement of the pressure-exerting plates upwards, spacer pieces, which may also be designed as strips, are provided on one of the two plates of the insert. As stops for delimiting the displacement of the pressure-exerting plates downwards, double-T-shaped stop pieces may be provided on one of the plates of the insert and engage in double-T-shaped recesses of spacer pieces fastened on the other plate. In order to simplify production, it may also be provided that a bolt which is fastened on the bottom plate of the insert passes through the other plate, with a guiding action, and has a widened head above the plate and a bearing shoulder beneath said plate.

BRIEF DESCRIPTION OF THE DRAWINGS

Exemplary embodiments of the invention are explained hereinbelow with reference to the drawing, in which.

DETAILED DESCRIPTION OF THE INVENTION

Figure 1:
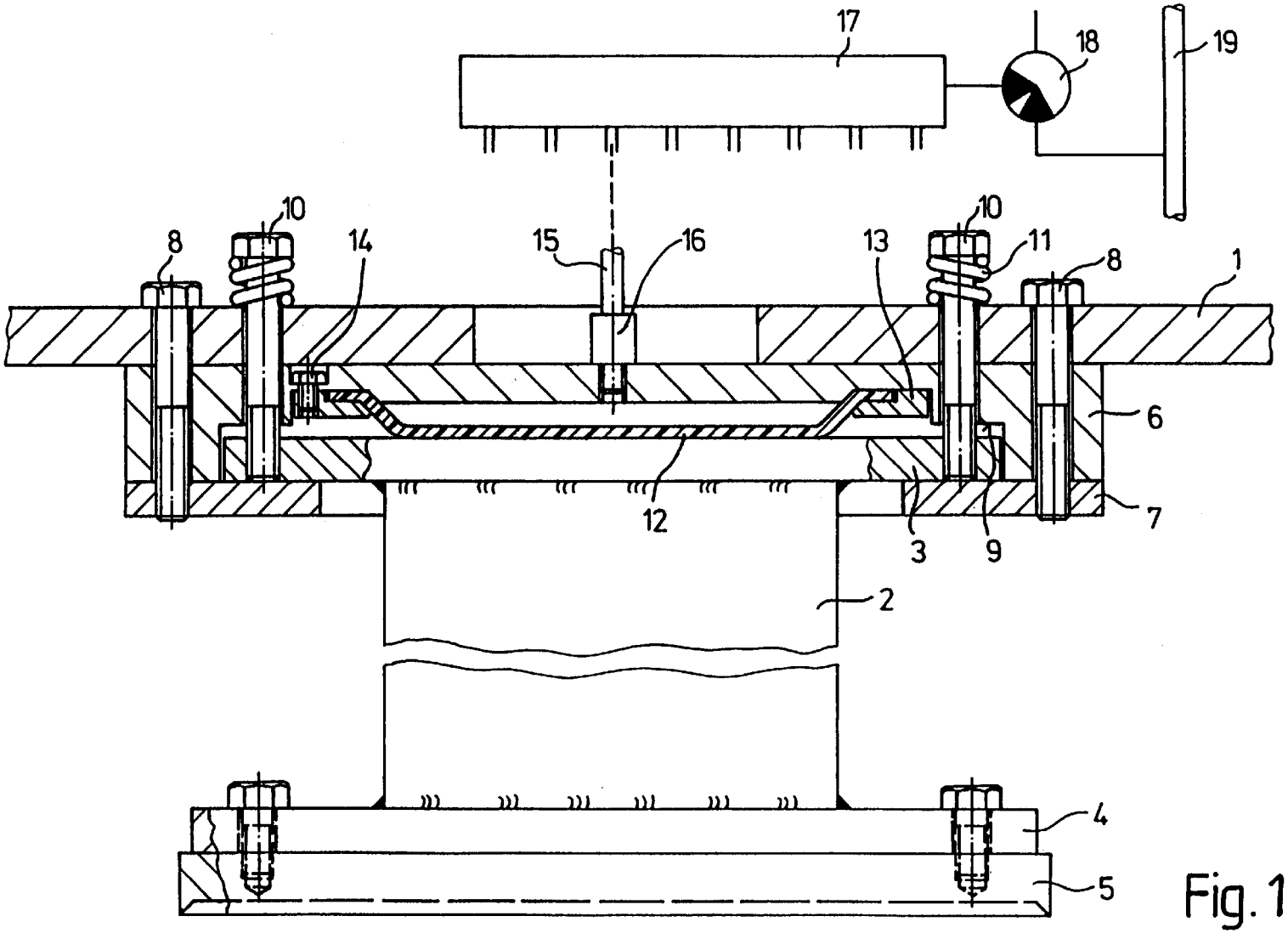
FIG. 1 shows a partial section of a movable die which can be activated by compressed air.

The illustration according to FIG. 1 has to be imagined as a detail of a top mold part, a fastening or load plate 1 bearing a plurality of dies also being depicted. The die shown is guided on said load plate so as to be vertically movable, the displacement being approximately 10 mm in the example. The die comprises a die shank 2 made of a quadrilateral tube, a head plate 3, a foot plate 4 and a pressure-exerting plate 5 which is screwed on the foot plate and whose border design, with a downwardly directed cutting edge, forms the bevel of the concrete paving sett which is to be produced using this mold. The head plate 3 of the die is guided in a diaphragm-receiving part 6 which, together with a retaining ring 7, is screwed on the load plate 1 by means of screws 8. The displacement of the head plate 3, and thus of the entire die, is delimited upwards by a stop surface 9 and downwards by the retaining ring 7. Spring screws 10 pass through the load plate 1 and the diaphragm-receiving part 6 in a displaceable manner by means of their top cylindrical shank sections and are screwed into the head plate 3 by means of the bottom shank sections. Compression springs 11 are clamped in between the heads of the spring screws 10 and the load plate 1 and draw the head plate 3 upwards against the stop surface 9 when the diaphragm is relaxed.

A diaphragm 12 is laid, from beneath, onto a central thin panel section of the diaphragm-receiving part 6 and is clamped in tightly between this section and a fastening ring 13. The latter is screwed on by means of screws 14. The diaphragm 12 can rest against the head plate 3 and force the latter downwards, counter to the force of the compression springs 11, as far as the stop when compressed air penetrates, through a line 15, which is connected by means of a screw-connection 16 which passes through the diaphragm-receiving part 6, into the inner space closed off by the diaphragm 12. The line 15 is connected to a distributor piece 17 which, for its part, is connected, via a three-way valve 18, to a compressed-air-supply line 19 of the relevant block-producing machine.

It is thus the case that, when the three-way valve 18 opens the connection between the compressed-air-supply line 19 and the distributor piece 17, the same air pressure is applied to all the diaphragms 12 and dies of the relevant top mold part of a multichamber mold. If the three-way valve 18 is changed over, then air is extracted from all the diaphragm chambers.

The operating process using such a mold takes place as follows: first of all, the mold is "filled" with concrete in the conventional manner. However, since this concrete is comparatively dry and is thus pourable only to a limited extent, it is assumed that, in view of the system difficulties described in the introduction, it is only possible to achieve a non-uniform degree of filling, i.e. two mold chambers which will be taken as examples here contain different quantities of concrete.

After this first filling operation, compaction takes place (so-called "preliminary ramming"). In this case, the dies are subjected to air pressure and are located in their bottom position, counter to the force of the springs 11. The concrete masses are compacted in the mold chambers under the action of the vibrators, which are always used in such machines, and the bearing pressure of the dies, the flexibility of the dies causing the surface of the compacted concrete masses to be higher in those mold chambers which were filled to a greater extent than in the chambers which were filled to a lesser extent.

By way of the secondary filling which then follows, and involves considerably smaller quantities, all the chambers are filled once again and the filling material is scraped off flush. However, there is a greater volume of secondary filling material in the chambers which were previously filled to a lesser extent. This produces a balancing of the volumes of concrete which have been introduced overall into the individual chambers, so that, during the then following secondary compaction operation, in which air is extracted from the pressure spaces above the diaphragms 12, an approximately equal height is achieved for all the concrete paving setts produced using this mold. As usual, for the secondary filling, use is made of so-called facing concrete, which forms the face and wearing surface of the paving sett.

Of course, it would also be possible for the three-way valve 18 to be supplemented by one or two pressure-reducing valves, which make it possible to set appropriately different pressures for the various compaction phases.

Figure 2:
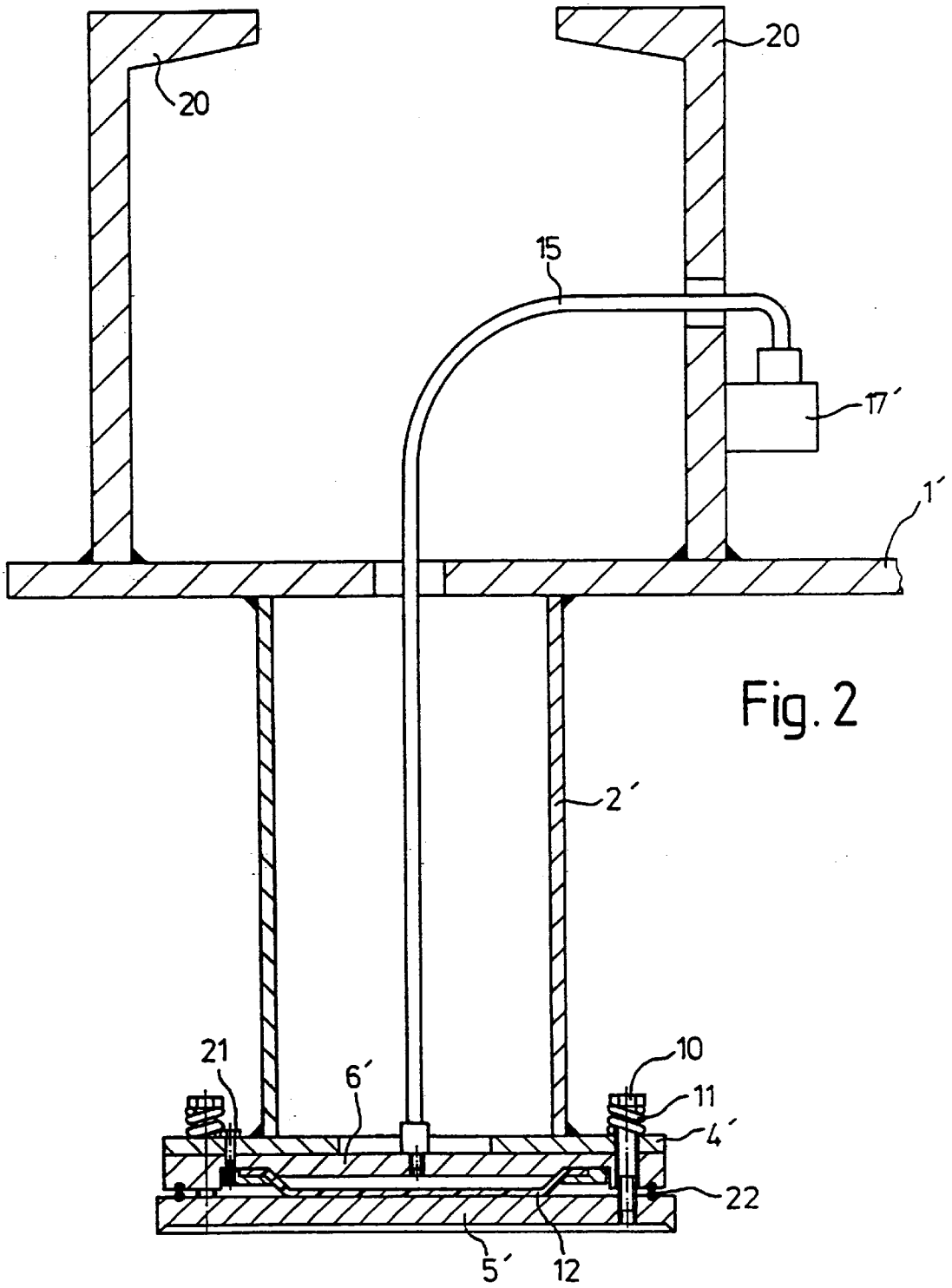
FIG. 2 shows a section of another die, in which only the pressure-exerting plate is movable and can be activated by compressed air.

The exemplary embodiment according to FIG. 2 shows reinforcement rails 20 provided on a load plate 1'. In contrast to FIG. 1, here the die shank 2' is welded firmly on the load plate 1' and bears a thin foot plate 4' at the bottom. A diaphragm-receiving part 6' is screwed on this foot plate 4' with the aid of screws 21, the screws also retaining, at the same time, the fastening ring of the diaphragm 12. Instead of the head plate 3 according to FIG. 1, it is the pressure-exerting plate 5' in this case which is suspended on spring screws 10. The diaphragm 12 rests directly against said pressure-exerting plate. A sealing ring 22 which spans the distance over which the pressure-exerting plate 5' is displaced prevents concrete slurry from penetrating into the space between the pressure-exerting plate and the diaphragm-receiving part. Here too, the individual pressure spaces are connected, via lines 15', to a distributor piece 17' whose internal pressure can be controlled as in the case of the first example.

Figure 5:
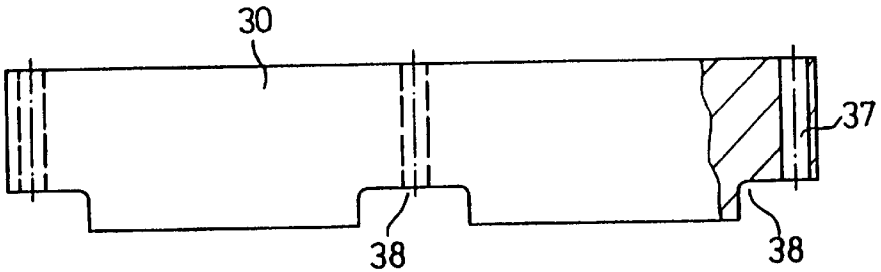
FIG. 5 shows a view of one of the two spacer strips of the insert which run in the transverse direction.
Figure 3:
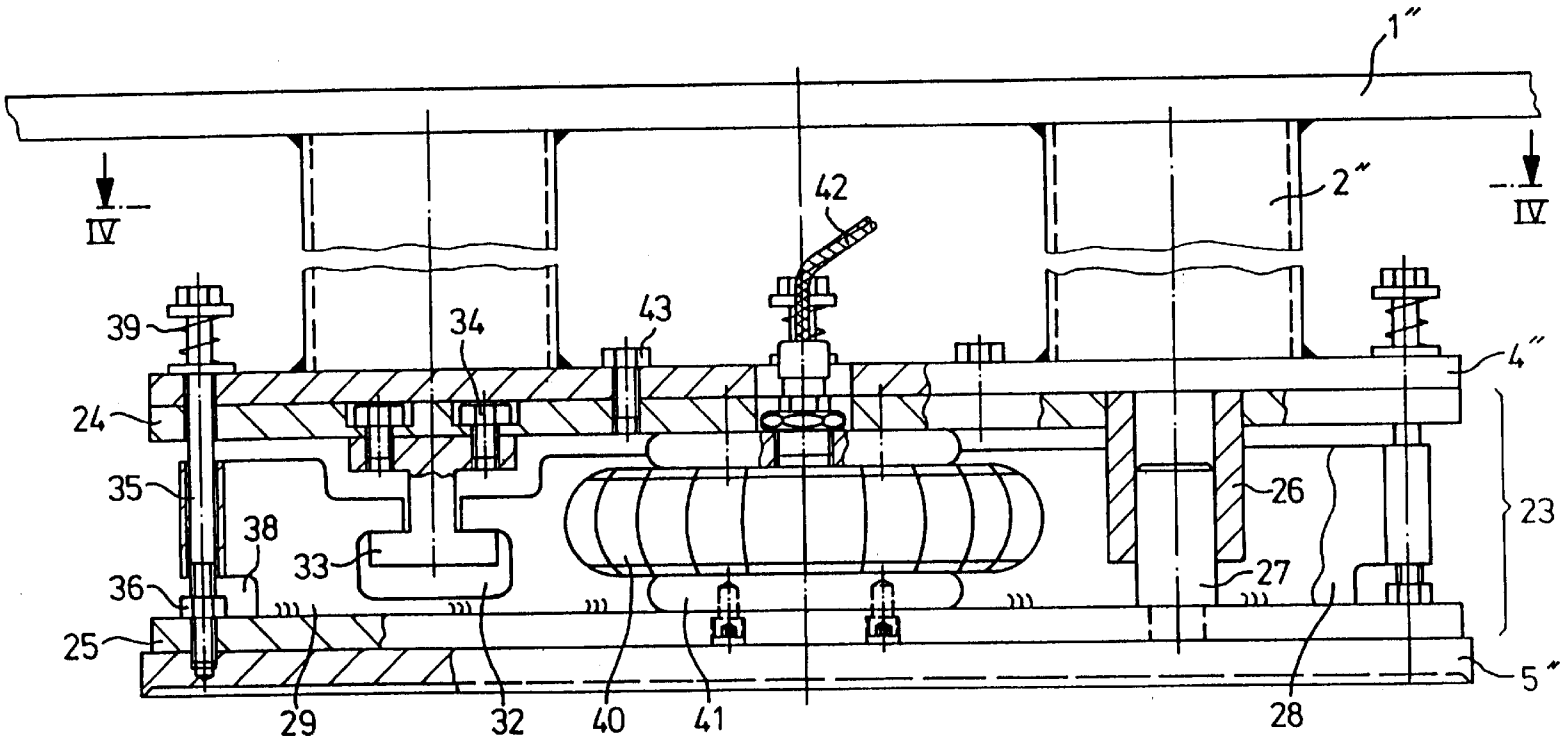
FIG. 3 shows a side view, partially in section, of an installed insert.
Figure 4:
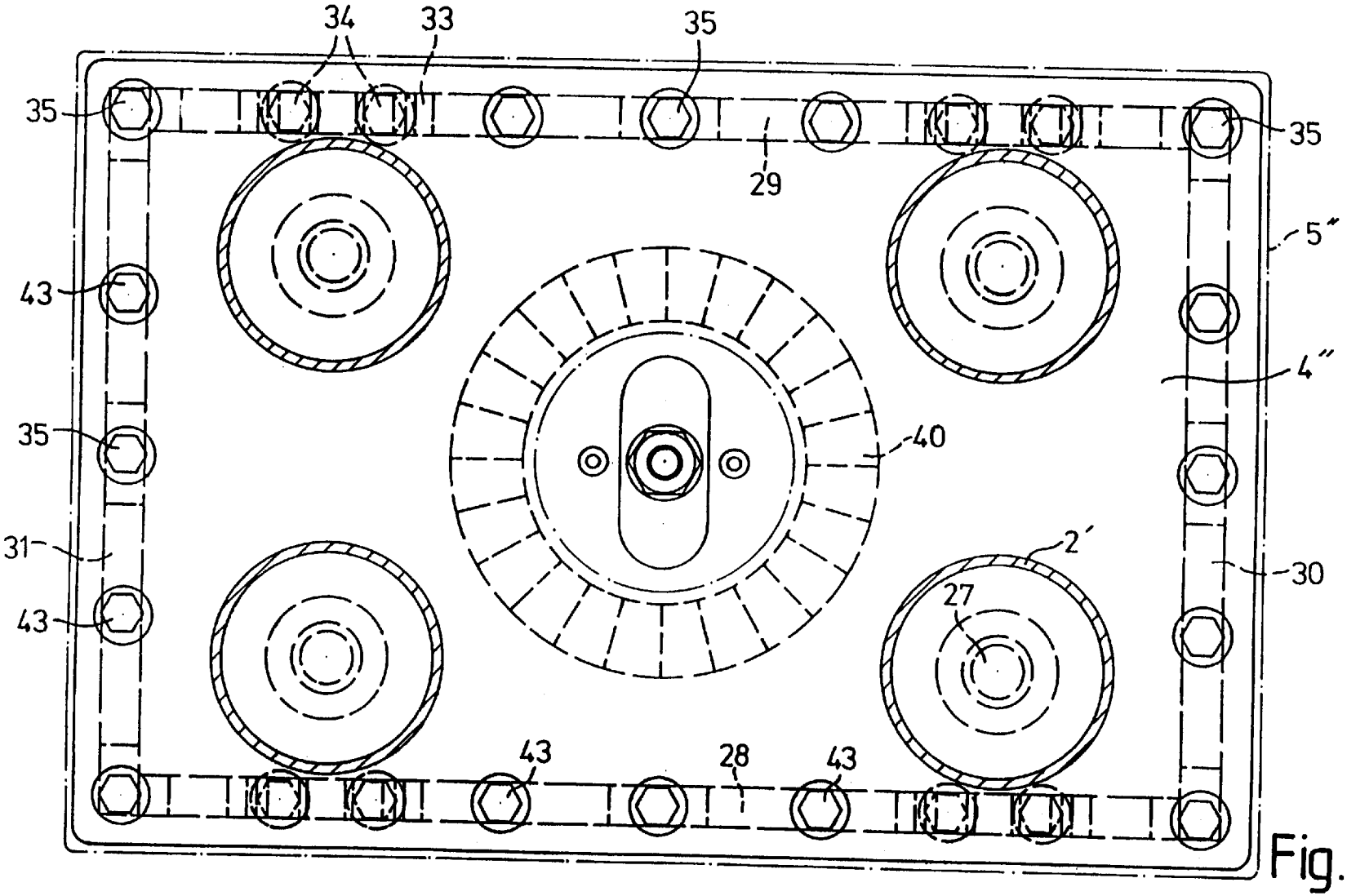
FIG. 4 shows a plan view of the die foot plate and of the insert along section line IV—IV.

In the exemplary embodiment according to FIGS. 3 to 5, all the components according to the invention are combined in an insert 23. This is introduced, as a retrofitting component, between the footplate 4" and the pressure-exerting plate 5" of a die, the four die shanks 2" of which are fastened on a load plate 1", as in the case of the examples described above.

The insert 23 comprises two assemblies which can be moved with respect to one another and are respectively characterized by a top plate 24 and a bottom plate 25. Fastened on the top plate 24, beneath each die shank 2", is a guide sleeve 26 which interacts with a guide bolt 27 on the bottom plate. Furthermore, four spacer strips 28 to 31 which are combined to give a quadrilateral are provided on the bottom plate 25. Of these spacer strips 28 to 31, FIG. 3 shows a longitudinal strip 28 and FIG. 5 shows a transverse strip 30 on its own. The longitudinal strips each have two double T-shaped recesses 32 which interact with double T-shaped stop pieces 33. The latter are connected firmly on the top plate 24 by two screws 34 in each case.

Screw-bolts 35, which have a number of functions, are provided at the four corners and in the center of the four sides in each case. Since they pass through all the plates and the spacer strips in the vertical direction, they first act, in addition to the guide sleeves 26 and guide bolts 27, as guide members. They then connect the pressure-exerting plate 5" to the bottom plate 25. They are screwed into the pressure-exerting plate 5", and a nut 36 clamps the two bottom plates together. In order to provide space for the nuts 36, the spacer strips 28 to 31 have rectangular border recesses 38 beneath their bores 37 for the screw-bolts 35. And, finally, the screw-bolts 35 serve for securing compression springs 39 which cushion the bottom assembly of the insert 23 as it moves downwards. The compression springs 39 are clamped in between the foot plate 4" and the respective head of the screw-bolt 35, with the interposition of discs.

In order to exert pneumatic compressive force on the bottom part of the insert 23 and the pressure-exerting plate 5" fastened thereon, the insert contains a bellows 40 which is made of rubber or the like and is screwed on the bottom plate 25 and the top plate 24 by means of two connection plates 41. The screw-connection of the bellows projects upwards through corresponding recesses in the top plate 24 and the foot plate 4". The indicated compressed-air tube 42 for the bellows is guided upwards between the die shanks 2".

It should also be pointed out that the top plate 24 is connected to the foot plate 4" by short screws 43. As is shown in FIG. 4, a total of eight such screws 43 are provided. It is thus also possible to use some of the screw holes which were present prior to the retrofitting of the insert 23.

The mode of operation corresponds to that of the exemplary embodiments described above. When the bellows 40 is in the slack, non-activated state, the spacer strips 28 to 31 rest against the top plate 24 as a result of the spring action. FIG. 3 shows the position when the bellows 40 has been activated by pressure. Its force overcomes the restoring forces of the springs 39, but the downwards movement is delimited by the double-T-shaped stop pieces 33, which come to rest against the protrusions formed by the recesses 32.

The inserts 23 may be prefabricated separately to the necessary dimensions for dies of any shape or size, which results in considerably more favorable operation during production. If necessary, it is also possible to exchange the pressure-exerting plates 5", e.g. in the case of wear, just as easily as before.

Figure 6:
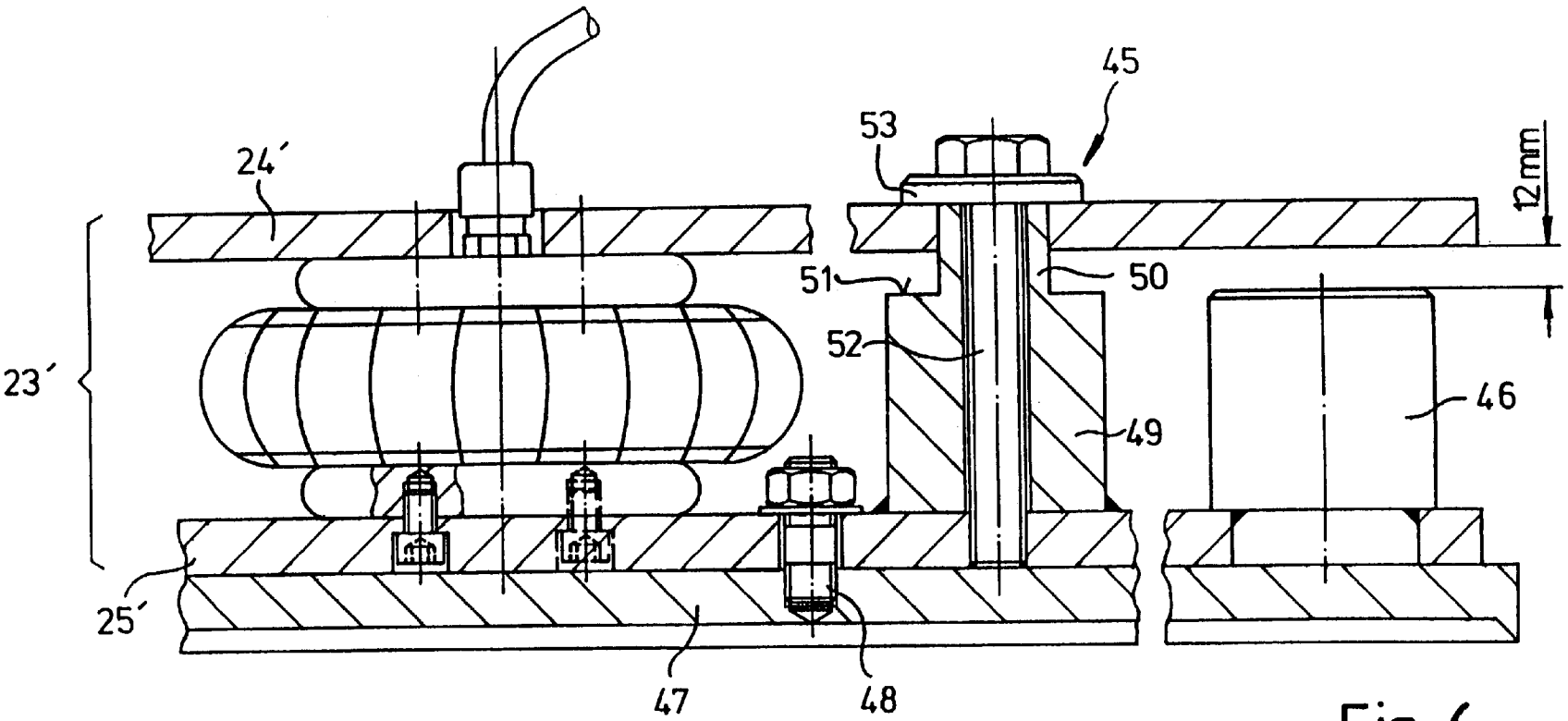
FIG. 6 shows a side view, partially in section, of segments of a further insert without springs.

The intention of the exemplary embodiment according to FIG. 6 is to indicate how a larger pressure-exerting plate can be provided on a die in accordance with the invention. In this case, use is made, on the one hand, of combined two-directional stops 45 and, on the other hand, of spacer pieces 46, which may be distributed in a suitable manner over the surface of the relevant pressure-exerting plate 47. The bellows 40 corresponds to the bellows according to FIG. 3. The screws 48 are used to fasten the pressure-exerting plate 47 on the bottom plate 25' of the insert 23' shown.

The two-directional stop 45 shown comprises a bolt, which comprises a larger-diameter bottom section 49 and a smaller-diameter top section 50. A shoulder 51 is formed as a result. The section 49 is welded to the bottom plate 25'. The top section 50 passes through the top plate 24' and permits displacement therein. A screw 52 is fitted through the bolt and screwed to the bottom plate 25'. Located beneath the head of this screw is a stop disc 53 which delimits the downward movement of the bottom part of the insert. On the other hand, the shoulder 51 forms an upwards stop. The possible displacement is 12 mm in this example. In addition to the shoulder 51, and precisely level with these, further pressure-exerting pieces 46, which are designed as strips or blocks, are welded to the bottom plate 25', by slot welding in the example. Since the mentioned striking action takes place between these stops and the top plate 24', a sufficiently large overall striking surface has to be ensured. The number and distribution, over the die surface, of the two-directional stops and the pressure-exerting pieces depends on the format and size of said die surface.

The advantages of providing a pressure-exerting plate on a die in this manner, in the case of which a striking action in the same rhythm as the vibrations takes place in the secondary compaction phase by virtue of appropriate air pressure of the bellows 40, are summarized once again as follows. The height and thickness tolerances of the concrete moldings produced is 1 mm. The compaction of the concrete, and thus the strength of the finished products, is the same throughout. It is also possible to manufacture large, comparatively thin panels with a crack-free surface, so that these panels have a low tendency to fracturing. In this case, the surface is textured uniformly. The hitherto frequently observed situation of the molded concrete panels sticking to the pressure-exerting plates of the dies no longer occurs; rather the pressure-exerting plates are detached without causing any defects.

What is claimed is:

1. A mold for manufacturing concrete moldings comprising:

a bottom mold part with mold chambers;

a top mold part with a load plate; and a plurality of dies, where there are as many dies as mold chambers and where each of said dies includes:

a die shank, one side of which is connected to said load plate;

a pressure-exerting plate connected to the other side of said die shank; and means for receiving a pressure medium and for moving said pressure-exerting plate away from said load plate and forcing it downward into contact with concrete in a respective one of said mold chambers in response to said pressure medium, said means including stops which define a displacement range of said pressure-exerting plate, wherein the pressure-exerting plate of each die is moved away from said load plate by the means of the respective die.

2. A mold according to claim 1, wherein the pressure medium is compressed air, and wherein said means comprises a pressure-medium chamber that is activated by the compressed air, said pressure-medium chamber acting on said pressure-exerting plate and having a movable wall.

3. A mold according to claim 2, wherein the movable wall is one of a diaphragm and a bellows.

4. A mold according to claim 2, wherein the pressure-medium chamber is arranged in a bottom region of each die.

5. A mold according to claim 2, wherein the die shank is mounted movably on the load plate and is connected firmly to the pressure-exerting plate; and the pressure-medium chamber is arranged approximately level with the load plate so that compressive forces from the pressure-medium chamber are exerted on the die shank.

6. A mold according to claim 1, wherein each die further comprises a foot plate (4"), which is connected firmly to the die shank (2") of the respective die, and an insert (23, 23') between said foot plate and the pressure-exerting plate (5") of the respective die, the insert having a top part with a top plate (24;24') and a bottom part which is guided so as to be vertically movable with respect to said top part and has a bottom plate (25;25'), the top plate being screwed to the foot plate and the bottom plate being screwed to the pressure-exerting plate, and wherein the means comprises at least one bellows (40) which is contained in the insert, the stops (33, 28 to 31; 46, 51, 53) additionally being contained in the insert.

7. A mold according to claim 6, wherein the insert further comprises interengaging guide bolts (27) and guide sleeves (26) on the two plates of the insert (23).

8. A mold according to claim 6, wherein the stops comprise spacer pieces (28 to 31; 46) on one of the two plates (24, 25; 24', 25) of the insert (23; 23').

9. A mold according to claim 6, wherein the stops comprise double-T-shaped stop pieces (33) on one of the plates (24, 25) of the insert (23) and spacer pieces with double-T-shaped recesses (32) fastened on the other plate of the insert to engage the double-T-shaped stop pieces.

10. A mold according to claim 6, wherein the insert further comprises a bolt (49, 50) which is fastened on the bottom plate (25') of the insert (23') and passes through the other plate (24') of the insert, with a guiding action, the bolt having a widened head (53) above said other plate of the insert and a bearing shoulder (51) beneath said other plate of the insert.

* * * * *